4/9/85 XR 4,509,596

United States Patent [19]

Emery

[11] Patent Number: 4,509,596

[45] Date of Patent: Apr. 9, 1985

[54] ENHANCED OIL RECOVERY

[75] Inventor: Leonard W. Emery, Plano, Tex.

[73] Assignee: Atlantic Richfield Company, Los Angeles, Calif.

[21] Appl. No.: 573,093

[22] Filed: Jan. 23, 1984

[51] Int. Cl.[3] ..... E21B 43/22

[52] U.S. Cl. ..... 166/263; 166/268; 166/273

[58] Field of Search ..... 166/263, 268, 273, 274, 166/305 R

[56] References Cited

U.S. PATENT DOCUMENTS

| | | | |
|---|---|---|---|
| 3,123,134 | 3/1964 | Kyte et al. | 166/263 |
| 3,266,569 | 8/1966 | Sterrett | 166/263 |
| 3,405,823 | 9/1969 | Jacoby et al. | 166/263 |
| 4,130,163 | 12/1978 | Bombardieri | 166/263 X |
| 4,271,905 | 6/1981 | Redford et al. | 166/263 |
| 4,450,913 | 5/1984 | Allen et al. | 166/263 X |

*Primary Examiner*—George A. Suchfield
*Attorney, Agent, or Firm*—Roderick W. MacDonald

[57] ABSTRACT

An enhanced oil recovery method which employs a pressurized gas injection process for the miscible displacement of oil from a subterranean geologic formation wherein the gas is injected into the formation so that the pressure in the formation increases above the miscibility pressure for the gas and oil in the formation and such injection is continued until the pressure in the formation approaches but does not exceed the fracture pressure of the formation, terminating gas injection before the formation is fractured, holding the injected gas in the formation to allow it to expand on its own into the formation thereby lowering the pressure in the formation, and injecting additional gas into the formation when the formation pressure has reached a point where it approaches but does not go below said miscibility pressure. The foregoing sequence of steps are repeated as many times as desired.

4 Claims, 3 Drawing Figures

ENHANCED OIL RECOVERY

BACKGROUND OF THE INVENTION

Heretofore it has been suggested, in an effort to produce more oil from a given subsurface geologic formation, to employ an enhanced oil recovery process which utilizes a gas under pressure. The gas is chosen for its ability to become miscible with the oil in the formation at the temperature and pressure conditions prevalent in the formation itself thereby developing, in-situ in the formation, a transition zone composed of light hydrocarbons from the oil and the injected, pressurized gas. This zone or phase is quite mobile and pushes its way through the formation forcing more oil out of the formation and into a producing well which the transition zone is moving toward.

In general, large quantities of gas are employed in such processes because pressures in the thousands of psig are normally employed. Often incremental oil recovery due to the enhanced oil recovery process is not as great as is desired because of a phenomenon known in the art as "fingering". When the injected gas and/or transition zone preferentially follow certain narrow paths through the formation rather than uniformly spreading out throughout the formation they are said to be fingering. The fingering process bypasses substantial amounts of oil in the formation which would otherwise be mobilized for recovery, and, therefore, is undesirable.

BRIEF SUMMARY OF THE INVENTION

In accordance with this invention an enhanced oil recovery method which employs a pressurized gas injection process for the miscible displacement of oil from a formation is employed but which uses a technique which produces less pronounced fingering and the same or greater amounts of oil than prior art miscible displacement processes. At the same time, this invention uses a lesser quantity of injected gas and expends less energy in injecting the gas into the reservoir. In other words, at least the same and in many cases, more oil is produced by employing the technique of this invention even though less gas is injected and lower gas injection energy input is used while achieving a greater swept volume of the producing formation, both vertically and horizontally.

In accordance with this invention, the above advantages are achieved by injecting the pressurized gas into the formation to raise the pressure in the formation above the pressure point at which the gas becomes miscible with the oil already present in the formation. Gas injection is then continued to raise the formation pressure until that pressure approaches, but does not exceed, the fracture pressure of the formation itself. Fracture pressure is the pressure at which the formation, due to its own physical characteristics and depth of overburden, actually separates to form elongated voids or cracks generally referred to as fractures through which fluids will preferentially travel because a void has been formed through which fluids such as oil or gas readily travel since there is no formation rock present in the void to resist their movement.

When the formation pressure is close to but not above the fracture pressure of the formation, injection of gas is terminated and the well shut in to maintain the gas under pressure in the formation. The pressurized gas is thus held in the formation without additional injection of other gas for a time sufficient to allow the gas to expand further into the reservoir, both horizontally and vertically, on its own and with no additional energy input from the surface of the earth such as by injection of additional pressurized gas, additional pumping, or the like. Thus, the pressurized gas is allowed to expand on its own outwardly into the formation and will do so equally in all directions since a compressed gas transmits its pressure equally in all directions, subject, of course, to normal limitations such as subsurface heterogeneties in the formation. The gas expands on its own without additional gas or energy input and continues to sweep oil from the formation by known miscible displacement mechanisms.

With the continued expansion of the gas with no additional input of gas in the formation, the formation pressure continually subsides and, if left alone will eventually reach the normal, pre-gas injection formation pressure. However, in accordance with this invention, the formation pressure is allowed to fall until it approaches the miscible pressure of the gas with the particular oil present in the formation but is not allowed to subside below this miscibility pressure. Additional pressurized gas is injected into the formation when the formation pressure approaches, but does not fall below, the miscibility pressure.

The foregoing sequence of steps is then repeated as many times as is necessary to obtain a thorough recovery of oil within the area of influence of the well in which the gas is being injected.

It can be seen from the above that since injected gas is periodically allowed to expand on its own without further gas or energy input and since gas is a quite compressible medium, substantially less gas is injected and substantially less gas injection energy is expended than when following the prior art technique of continually injecting pressurized gas very near the fracture pressure of the formation without let up.

Accordingly, it is an object of this invention to provide a new and improved enhanced oil recovery method.

It is another object of this invention to provide a new and improved pressurized gas injection process for the miscible displacement of oil from a subterranean geologic formation.

Other aspects, objects and advantages of this invention will be apparent to those skilled in the art from this disclosure and the appended claims.

DETAILED DESCRIPTION OF THE INVENTION

Figure 1:
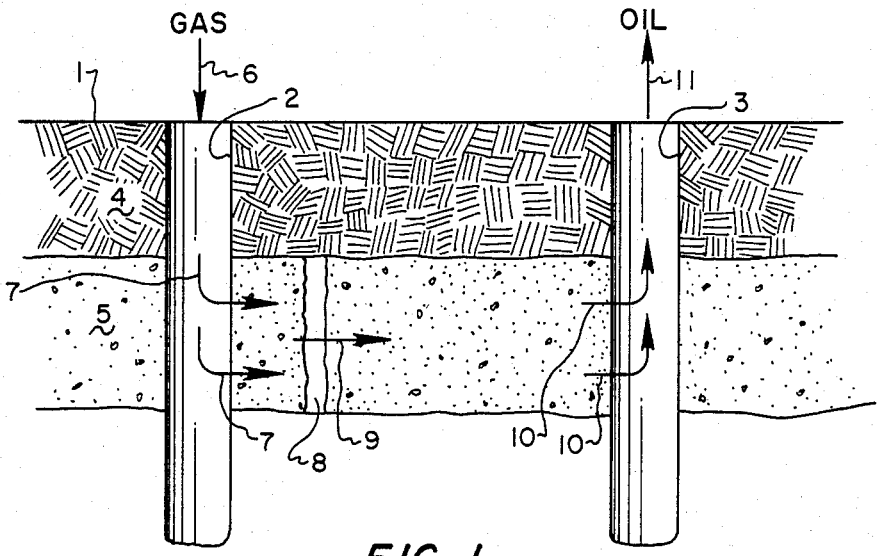
FIG. 1 shows a cross section of a portion of the earth's crust which has an oil producing formation and two wells penetrating same.

FIG. 1 shows the earth's surface 1 having two wells 2 and 3 extending essentially vertically down into earth 4 and penetrating a subterranean geologic oil producing formation 5.

In accordance with prior art miscibility displacement procedures, a suitable miscible displacement gas 6 is injected into injection well 2 and passes as shown by arrows 7 into oil producing formation 5 to mix with oil present in formation 5 and develop a transition phase or zone 8 containing light hydrocarbons from oil in formation 5 and produced by miscible mixing of gas 6 and oil in formation 5. Because of continued injection of gas 6 into formation 5, zone 8 moves in the direction of arrow 9 towards producing well 3 thereby forcing oil from formation 5 into well 3 as shown by arrows 10 for production to the earth's surface as shown by arrow 11. By prior art procedures, gas 6 is injected into formation 5 at as high a pressure as possible and continuously injected until gas 6 reaches producing well 3. Thus, in many of these prior art procedures, gas 6 is injected at a pressure just below the fracture pressure of formation 5 and is continued to be injected at this pressure until gas reaches well 3. These injection pressures can be several thousands of psig. Therefore, considerable amounts of gas are compressed and remain compressed in formation 5 during the entire life of the gas injection process between wells 2 and 3.

By employing the technique of this invention, the gas compressed into formation 5 does not remain at that high pressure during the entire life of the gas injection process between wells 2 and 3 but rather well 2 is periodically shut in to seal in to formation 5 what amount of compressed gas is already present in that formation. That gas is then allowed to continue to expand in the formation towards well 3 and thereby continue to produce oil from the formation into well 3 even though no additional gas 6 is injected into well 2 during this time. Thus, essentially free displacement of oil from formation 5 is obtained and greater use of the quantity of compressed gas present in formation 5 is achieved since the compressed gas expands on its own without additional gas injection from the earth's surface while this compressed gas expands on its own.

The compressed gas is, however, not allowed to expand on its own to a formation pressure below the miscibility pressure of the gas in formation 5. When the formation pressure approaches the miscibility pressure of that gas in that formation, additional gas 6 is injected into formation 5 thereby starting to increase the pressure of the gas in formation 5 and gas injection is continued until the pressure of the gas in the formation again builds up to a point where it approaches the fracture pressure of the formation. Well 2 is then again shut in, the compressed gas allowed to expand on its own with no further surface gas injection until the gas in formation 5 expands itself into the formation to an extent that it again approaches the miscibility pressure. Thereafter surface gas injection is resumed and this sequence of steps repeated as many times as is necessary to thoroughly remove the oil from formation 5 between wells 2 and 3.

It can be seen that by allowing compressed gas to expand on its own periodically in reservoir 5 and terminating surface gas injection during these in-situ expansion periods, the same or greater swept volume, both vertical and horizontal, of formation 5 between wells 2 and 3 is achieved as compared to a process which injects gas 6 at a continuous high pressure level for the entire production period. Further, the swept volume of formation 5, i.e., the volume of formation 5 through which transition zone 8 passes before it reaches producing well 3, is better covered by this invention because, by not using a very high gas pressure continuously throughout the whole producing period, the fingering phenomenon is minimized.

Figure 2:
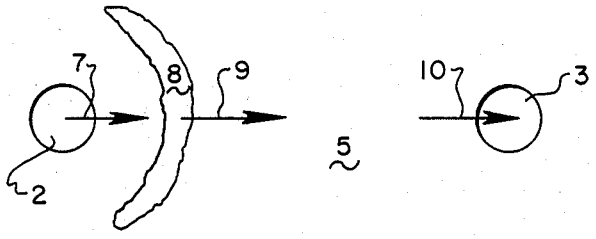
FIG. 2 shows a plan view of a desirable miscible displacement process which contains a relatively uniform miscible displacement transition zone.

FIG. 2 shows a plan view of a section of formation 5 between wells 2 and 3 wherein transition zone 8 is moving towards production well 3 as indicated by arrow 9. The configuration of transition zone 8 is an idealized configuration in that it is quite uniform and thereby achieves an efficient swept volume of formation 5 by transition zone 8 before that zone reaches production well 3.

Figure 3:
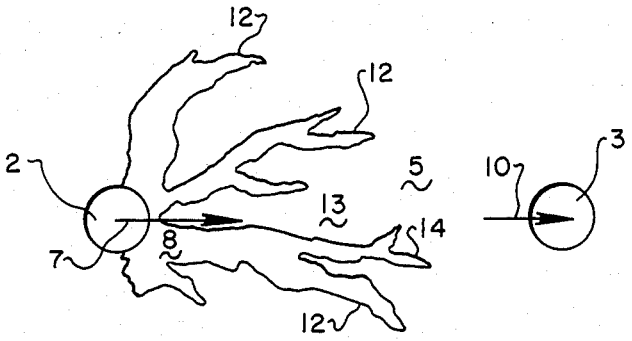
FIG. 3 shows a plan view similar to that of FIG. 2 except that the injected fluid is undergoing substantial undesired fingering in the formation.

FIG. 3 shows transition zone 8 when the fingering phenomenon is taking place as is often the case when continued high pressure injection is carried out through the entire producing period. As can be seen from FIG. 3 branches or fingers 12 extend in all directions following inherently weaker zones within formation 5 thereby bypassing substantial amounts of oil in zones such as area 13 which exhibit a higher resistence to transition zone 8. Areas such as 13 are simply bypassed by zone 8 thereby leaving all the oil present in area 13 unproduced because when an advanced finger such as 14 reaches producing well 3, the production period between these two wells is over even though substantial amounts of oil are still present in formation 5.

By periodically allowing the injected gas in formation 5 to expand on its own to a reduced pressure approaching the miscible pressure, fingers such as 12 and 14 are not pushed as rapidly towards well 3 but rather are allowed to expand laterally in a less pressurized mode. This allows the fingers to expand in all directions thereby fattening the fingers, making those fingers less pronounced as shown in FIG. 3, and making the transition zone 8 approach the more idealized configuration of FIG. 2. Further, in accordance with this invention, all this is achieved with the injection of lesser quantities of gas and lesser energy expended for injection of that gas into formation 5. The swept volume of formation 5, when following this invention will have substantially less bypassed areas 13 thereby producing more oil into well 3 even though less total gas is injected and less energy is expended for injecting that gas. For more discussion concerning the fingering phenomenon, see Habermann, "The Efficiencies of Miscible Displacement as a Function of Mobility Ratio", *Transactions AIME*, 1960, Volume 219, Pages 264 through 272.

Generally, any well known miscible displacement gas can be employed in this invention. The most preferable gas to be employed is carbon dioxide because its miscible displacement pressure with most oils is substantially below the fracture pressure of essentially all known formations. The injection pressure of the gas will vary widely depending upon the characteristics of the formation, the oil present in the formation and the depth of the formation below the earth's surface, i.e., overburden height, so specific injection pressures cannot be reasonably recited. Such pressures will be very readily ascertainable by those skilled in the art once the technique of this invention and its goals are known. Similar reasoning applies to other process parameters for this invention, but all formations have a fracture pressure and the oil present a miscibility pressure with carbon dioxide or other known miscible displacement gases so that one skilled in the art can readily determine once the specific formation, oil, and gas is known, the minimum (miscibility) pressure and maximum (fracture) pressure to be used in practicing this invention. Although not critical to a proper functioning of this invention so long as the fracture and miscibility pressure limits are not exceeded, the gas pressure should not generally be allowed to increase beyond a point which is about 100 psig below the fracture pressure and the pressure of the shut-in, expanding gas should generally not be allowed to decrease beyond a point which is about 100 psig above the miscibility pressure.

EXAMPLE

The process of this invention is carried out in a gas injection, oil production system such as that shown in FIG. 1 wherein the fracturing pressure of formation 5 is approximately 3000 psig, carbon dioxide is employed as the injecting gas 6 and the miscibility pressure of the carbon dioxide with the particular oil present in formation 5 is approximately 1000 psig. Carbon dioxide is injected through well 2 at a volumetric rate and in a quantity such that the pressure in formation 5 adjacent well 2 increases until it approaches but does not exceed 3000 psig. When this pressure is approximately 2900 psig, carbon dioxide injection into well 2 is terminated, well 2 sealed so the carbon dioxide cannot escape from formation 5 back to the earth's surface through well 2, and the compressed carbon dioxide present in formation 5 allowed to expand on its own with no further gas injection into well 2 until the pressure in formation 5 approaches about 1100 psig. Well 2 is then reentered and carbon dioxide injection resumed thereby increasing the pressure in formation 5 until it again approaches 3000 psig after which well 2 is again shut in, the injected gas in formation 5 again allowed to expand on its own until its pressure reapproaches 1000 psig after which carbon dioxide injection from earth's surface 1 is resumed and this sequence of steps repeated over and over until transition zone 8 reaches well 3.

Reasonable variations and modifications are possible within the scope of this disclosure without departing from the spirit and scope of this invention.

What is claimed is:

1. In an enhanced oil recovery method which employs a pressurized gas injection process through at least one injection well for the miscible displacement of oil from a subterranean geologic formation, wherein said gas has a pressure in said formation above which said gas becomes miscible with said oil, and said formation has a pressure point above which it fractures, said fracture pressure being above said miscibility pressure, the improvement comprising (1) injecting said gas at a volumetric rate and in a quantity such the pressure in said formation increases above said miscibility pressure and continuing the injection of said gas to increase said formation pressure until it approaches but does not exceed said fracture pressure, (2) terminating gas injection before said formation pressure reaches said fracture pressure and shutting in said at least one injection well thereby holding said injected gas in said formation to allow it to expand outwardly into said formation on its own thereby lowering said formation pressure, and (3) injecting additional gas into said formation when the gas in said formation has expanded pursuant to step (2) above to the extent that said formation pressure approaches but does not go below said miscibility pressure whereby oil production is possible during one or more of steps (1), (2) and (3).

2. The method according to claim 1 wherein steps (1), (2), and (3) are repeated in sequence a plurality of times.

3. The method according to claim 1 wherein said gas is carbon dioxide.

4. The method according to claim 1 wherein in step (1) said formation pressure is not allowed to increase beyond a point which is about 100 psig below said fracture pressure, and in step (2) said formation pressure is not allowed to decrease beyond a point which is about 100 psig above said miscibility pressure.

* * * * *